US008210402B2

(12) United States Patent
Kleinow et al.

(10) Patent No.: US 8,210,402 B2
(45) Date of Patent: Jul. 3, 2012

(54) SLAG CONTROL SHAPE DEVICE WITH L-SHAPE LOADING BRACKET

(75) Inventors: Daniel Kleinow, Carleton, MI (US); Joseph Mullen, Carleton, MI (US)

(73) Assignee: AJF, Inc., New Boston, MI (US)

( * ) Notice: Subject to any disclaimer, the term of this patent is extended or adjusted under 35 U.S.C. 154(b) by 375 days.

(21) Appl. No.: 12/367,597

(22) Filed: Feb. 9, 2009

(65) Prior Publication Data

US 2010/0200620 A1 Aug. 12, 2010

(51) Int. Cl.
*B22D 41/16* (2006.01)

(52) U.S. Cl. ..... 222/602; 222/597; 222/591; 266/271; 266/272

(58) Field of Classification Search ..... 222/602, 222/594, 597, 590, 591; 266/230, 227, 45, 266/272, 271
See application file for complete search history.

(56) References Cited

U.S. PATENT DOCUMENTS 3,627,180 A 12/1971 Montgomery
3,744,684 A 7/1973 Heimgartner
3,848,781 A 11/1974 Springer
4,468,013 A * 8/1984 LaBate ..... 266/272
4,494,734 A * 1/1985 LaBate et al. ..... 266/45
4,520,861 A 6/1985 Sobolewski et al.
4,601,415 A 7/1986 Koffron
4,634,106 A 1/1987 LaBate, II
4,637,592 A 1/1987 La Bate, II et al.
4,640,498 A 2/1987 LaBate et al.
4,645,534 A 2/1987 D'Angelo et al.
4,666,134 A 5/1987 Folgerö
4,709,903 A 12/1987 LaBate
4,718,644 A 1/1988 Hoffman et al.
4,791,978 A 12/1988 Fishler
4,799,650 A 1/1989 Labate
4,871,148 A 10/1989 Koffron
4,905,755 A 3/1990 Lothmann
4,936,553 A 6/1990 Smith
4,953,761 A * 9/1990 Fishman et al. ..... 222/602
4,968,007 A 11/1990 Forte et al.
5,004,130 A 4/1991 Vateriaus
5,044,610 A 9/1991 Koffron
5,071,107 A 12/1991 Schmidt et al.
5,079,950 A 1/1992 McKiernan et al.
5,080,327 A 1/1992 Bai
5,083,689 A * 1/1992 Vaterlaus ..... 222/602
5,083,754 A 1/1992 Russo
5,118,085 A 6/1992 Forte et al.
5,145,634 A 9/1992 Hintzen
5,164,098 A 11/1992 Brown et al.
5,171,513 A 12/1992 Vassilicos
5,183,624 A 2/1993 Bruckner et al.
5,259,596 A 11/1993 Ruffaldi
5,286,009 A 2/1994 Moore et al.
(Continued)

*Primary Examiner* — Scott Kastler
*Assistant Examiner* — Michael Aboagye
(74) *Attorney, Agent, or Firm* — Young & Basile, P.C.

(57) ABSTRACT

A slag control shape is releasably mounted on a mounted member carried on a molten vessel or an adjacent base. The mounted member includes an L-shaped bracket carrying a movable member to release the slag control shape and an actuator for selectively releasing the slag control shape. The mounting member further includes a sleeve secured to the vessel or adjacent base. A rotating shaft is connectable to both the L-shaped bracket and sleeve to provide rotatable movement in selective positions, of the L-shaped bracket relative to the sleeve.

14 Claims, 3 Drawing Sheets

U.S. PATENT DOCUMENTS 5,303,902 A 4/1994 Forte et al.
5,312,090 A 5/1994 Seaton et al.
5,333,764 A 8/1994 Kassuba
5,372,355 A * 12/1994 Henn et al. ..... 266/236
5,382,003 A 1/1995 Sankaranarayanan et al.
5,382,004 A 1/1995 Connors, Sr. et al.
5,421,559 A 6/1995 Basler
5,421,560 A 6/1995 Forte et al.
5,451,036 A 9/1995 Eastwood
5,472,178 A 12/1995 Paar et al.
5,526,112 A 6/1996 Sahagen
5,645,792 A * 7/1997 Forte et al. ..... 266/230
5,674,426 A 10/1997 Schmid et al.
5,691,061 A 11/1997 Hanse et al.
5,766,543 A 6/1998 Dainton
5,851,414 A 12/1998 Ando et al.
6,074,598 A 6/2000 Koffron et al.
6,113,669 A 9/2000 Vorobeichik et al.
6,153,146 A 11/2000 DeMarco
6,280,499 B1 8/2001 Koffron
RE37,417 E 10/2001 Koffron
6,471,911 B1 * 10/2002 Pleschiutschnigg et al. ... 266/45
6,576,039 B2 6/2003 Koffron et al.
6,602,069 B2 8/2003 Purchase
6,723,275 B2 4/2004 Koffron et al.
6,784,429 B2 8/2004 De Saro et al.
6,940,317 B2 9/2005 Suga
6,951,296 B2 10/2005 Siek
6,960,317 B2 11/2005 Dussud et al.
2002/0024173 A1 2/2002 Scriven et al.
2004/0104520 A1 6/2004 Mancusi
2004/0108636 A1 6/2004 Dussud et al.

* cited by examiner

SLAG CONTROL SHAPE DEVICE WITH L-SHAPE LOADING BRACKET

BACKGROUND OF THE INVENTION

1. Field of the Invention

The present invention relates, in general, to metal making apparatus and, specifically, to molten metal receptacles and, more specifically, to a slag control shape loading device used in molten metal vessels.

2. Description of the Art

In metal making processes, such as steel making, molten metal is transferred from a furnace or converter by a ladle to a tundish or directly to a casting machine. In all metal making processes, and, in particular, in steel making processes, a layer of slag containing metal impurities forms above the top surface of the molten metal within the ladle and the tundish. When the molten metal is discharged from the ladle or tundish, it is necessary to maintain a separation between the slag and the molten metal so that high quality steel without significant amounts of slag can be produced.

The slag forms a layer of impurities several inches thick on top of the layer of molten metal in the ladle and in the tundish. In addition, the flow of molten metal through the discharge nozzle in the ladle or tundish creates a vortex which introduces a conically-shaped rotation to the molten metal immediately above the discharge nozzle. When a sufficient quantity of molten metal is maintained within the ladle or tundish, the vortex forms completely within the molten metal layer and does not reach to the slag layer atop the molten metal layer. However, when the level of molten metal within the ladle or tundish drops below the predetermined critical depth, the vortex reaches into the slag layer and draws slag through the center of the vortex to the discharge nozzle along with molten metal. This causes the introduction of slag into the molten metal as it is discharged from the ladle or the tundish and results in steel having less than desirable quantities as well as creating a potentially hazardous situation.

In order to prevent the introduction of slag into the molten metal, various slag control shapes, such as balls, frusto-conical bodies, etc., as shown in U.S. Pat. Nos. 4,725,045 and 4,968,007, are introduced into the transfer ladle or tundish. Such slag control shapes or bodies have a predetermined specific gravity less than the specific gravity of the molten metal and greater than the specific gravity of the slag layer so that the slag control shape or body is buoyantly supported at the interface between the slag layer and the molten metal layer. Such slag control bodies or shapes are also designed to locate and center themselves automatically in the vortex formed above the discharge nozzle from the molten metal vessel or receptacle. The lower portion of such slag control bodies is disposed in the molten metal layer and will enter and seat within the upper portion of the discharge nozzle of the molten metal receptacle when the molten metal layer drops below a predetermined depth so as to block the discharge nozzle and prevent the discharge of slag from the receptacle.

While such slag control bodies or shapes have found widespread use and effectively block the undesirable discharge of slag from a molten metal vessel, such as a transfer ladle or tundish, the introduction of such slag control bodies into the molten metal receptacle has proved to be a problem.

Typically, such slag control bodies are introduced into the transfer ladle or tundish at a predetermined time during the discharge of molten metal from the ladle or tundish. The time of insertion of the slag control body is based on an operator's experience, typically on the total time of molten metal discharge, or on a potentially inaccurate vessel or ladle weight reading from a load cell in a ladle weight system. As ladles positioned in caster turret arms are typically 20 feet or more in height, overhead cranes have been used to drop the slag control body into the ladle at the point in time indicated by an operator. However, such cranes are assigned numerous other tasks which make it difficult to insure that a crane is available at the precise time that the operator determines it necessary to insert the slag control body into the molten metal vessel.

A small number of metal making or casting machine installations have a stairway located adjacent the discharge position of a ladle which enables a worker, such as a ladleman, to climb to the top of the ladle and insert the slag control body into the ladle at the required time. However, the height of the ladle, the approximate 25 pounds or more weight of the slag control body, and the high temperatures involved in the molten metal process make such a task difficult, undesirable and dangerous. Further, the ladleman typically has other duties in monitoring the metal making process which must be neglected for the time it takes to climb the stairs and insert the slag control body. Dedicating one person solely to the task of inserting the slag control body into the molten metal vessel at the required time adds costs to the metal making process as such an individual is only required is to perform his single task at widely spaced, intermittent intervals.

Further, when such slag control shapes are dropped into a molten metal vessel, they typically fall from 10 to 15 feet before hitting the slag layer. Due to the buoyancy characteristics of a slag control shape and its momentum during dropping into the vessel, the slag control shape will initially pass through the slag layer and into the molten metal and then bob up out of the molten metal and slag until it settles at the molten metal/slag interface. However, this bobbing force and the inherent buoyancy characteristics of a slag control shape frequently cause the slag control shape to settle at a position away from a desired position directed above the discharge outlet of the molten metal vessel. Indeed, it is infrequent for the slag control shape to settle directly over the discharge outlet since the discharge outlet is typically 2½ to 4½ inches in diameter as compared to the 10 to 20 foot diameter of a typical ladle. Thus, when a vortex begins to form above the discharge outlet when the molten metal reaches a low level within the ladle or vessel, the slag control shape may not be able to reach the vortex in time to serve its function of blocking the outlet to prevent the discharge of slag through the outlet. Furthermore, even if the slag control shape initially settles directly over the discharge outlet, it frequently drifts away since a vortex may not have formed above the outlet and never returns to the desired centered position thereby defeating its intended purpose.

In order to address these problems, one of Applicants' previously devised a slag control shape release apparatus which is disclosed in U.S. Pat. No. 5,249,780 issued on Oct. 5, 1993. In this apparatus, the hanger of a slag control shape extends through a bore in a molten metal vessel cover and, also, through a bore in a lid pivotally mounted on the cover. A pin is mounted on the lid and biased to a position extending through the hanger to support the slag control shape on the cover. An actuating cable is connected to the pin and extends from the cover to an easily accessible position for remote actuation of the release mechanism to release the pin from the slag control shape and to allow the descent of the slag control shape into the molten metal vessel.

A similar release apparatus has also been devised by one of the Applicants and is disclosed in U.S. Pat. No. 5,303,902 issued on Apr. 19, 1994. In this apparatus, a mounting means including a reciprocally movable pin is mounted on a frame pivotally mounted on the cover of a molten metal vessel and is actuated by a cable extending from the pin to a free end remote from the cover. A cable wound around a reel mounted on the frame is attached to the slag control shape to control the descent of the slag control shape into the molten metal vessel after release from the pin.

Yet another release apparatus has been devised by one of the Applicants' and is disclosed in U.S. Pat. No. 5,423,522, which issued on Jun. 13, 1995. In this release apparatus, a lid is removably implacable in a bore in the cover. The hanger or rod of a slag control shape extends through the lid and is releasably received in mounting means on the lid. The actuating means is similar to that in the other release devices devised by the Applicants' in that it is in the form of a cable having an end operable from a location remote from the cover on the molten metal receptacle. In this latter design, means are provided for releasably connecting the actuating means to the mounting means after the mounting means and the lid have been mounted on the cover. This enables the heavy mounting and activating means to be mounted on the lid rather than on the cover which is typically formed of lightweight refractory or ceramic fiber materials.

In the slag control apparatus, also devised by one of the Applicants, and shown in U.S. Pat. No. 5,421,560, issued on Jun. 6, 1995, the mounting means of the slag control shape release apparatus includes a frame fixedly mounted on a lid and slidably supporting a tubular pin. The pin supports the hanger of the slag control shape at one end. A biasing means mounted on the frame normally biases the pin to a first position. The actuating means is releasably connected to the mounting means for actuating the mounting means to release the slag control shape. The actuating means is also operable from a location remote from the cover. In one embodiment, a weight control means determines the weight of the ladle indicate the amount of molten metal remaining in the receptacle. At an appropriate preset weight, a controller transmits a radio frequency signal to the actuating means to automatically release the slag control shape into the molten metal receptacle.

While all of these apparatus have proved effective at accurately dropping a slag control shape into a molten metal vessel and permitting the timely release of the slag control shape from an easily accessible location remote from the cover on top of a molten metal vessel, all except the latter release apparatus require the manual intervention of the ladleman or operator at the proper time to pull the cable to release the slag control shape from the cover. Despite the close location of the end of the cable connected to the actuating means in each of these release devices to the operator, the operator is still required to move at least a short distance to grasp and pull the cable. Thus, it would be desirable to provide a slag control shape release apparatus for use with a molten metal receptacle or vessel which enables an operator to release a slag control shape into the receptacle from a location more convenient or closer to the usual location of the operator or ladleman on the casting platform adjacent to the ladle.

SUMMARY OF THE INVENTION

A slag control shaped release apparatus for a molten receptacle is disclosed which includes a sleeve connected to the metal receptacle or an adjacent base. An L-shaped bracket is mountable to the sleeve wherein the L-shaped bracket is rotatable relative to the sleeve. The bracket has means for releasably mounting a slag control shape in which the mounting means is movable between a first position releasably mounting a slag control shape and a second position releasing the slag control shape for falling into the molten metal receptacle, the means for releasibly mounting the slag control shape includes a spring biased sliding pin.

In another aspect of the invention a rotatable shaft is disposed between the sleeve and the L-shaped bracket. The rotatable shaft is a cylindrical member having a through center aperture extending the length of the shaft and diametrically opposing pegs extending from the shaft in a central portion of the shaft.

Further, in another aspect of the invention the sleeve has a top surface with a plurality of notches formed therein for receiving the diametrically opposing pegs.

In yet another aspect of the invention, a horizontal portion of the L-shaped bracket includes a bar carrying the means for releasibly mounting the slag control shape including a bracket sleeve having a portion connect to the bar and a movable portion carried on a slide pin.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
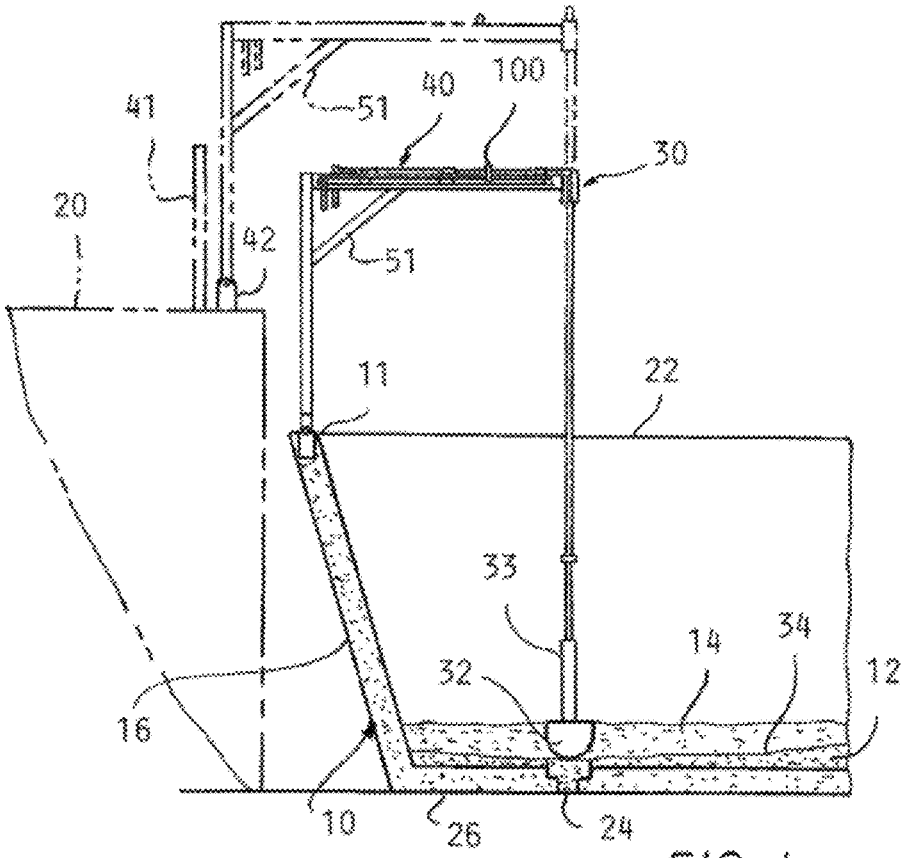
FIG. 1 is a partial cross-sectioned, side elevational view of a molten metal receptacle employing a slag control shape release apparatus according to the present invention.

As shown in FIG. 1, a molten metal receptacle 10 is provided for containing a layer of molten metal 12, such as steel, etc. As is conventional, a layer of slag 14 forms on the top of the layer of molten metal 12 within the vessel 10. Although the molten metal vessel 10 is illustrated as being in the form of a transfer ladle used to transfer molten metal from a tapping converter or furnace to a tundish or casting machine, it will be understood that the slag control shape release apparatus of the present invention may also be employed with other types of molten metal vessels, such as tundishes, etc.

By way of background, the molten metal vessel or ladle 10 includes outer, side walls 16 typically formed of a metallic outer shell and an inner layer formed of a refractory material, such as firebrick, etc. An open top end 22 is formed on the ladle 10. A discharge nozzle or outlet 24 is formed in a bottom wall 26 of the ladle 10 and provides an outlet path for molten metal from the ladle 10 to a tundish casting machine, etc.

As is conventional, a slag control shape or body denoted generally by reference number 32 in FIG. 1, is employed to prevent the discharge of slag 14 through the discharge nozzle 24 when the layer 12 of molten metal reaches a predetermined low depth. The slag control shape or body 32 may have any predetermined size and shape, such as that disclosed in U.S. Pat. No. 4,968,007 or the plug shown in U.S. Pat. No. 4,725,045. The contents of U.S. Pat. No. 4,968,007, with regard to the description and use of the slag control body, are incorporated herein by reference. Generally, however, such slag control shapes or bodies 32 are formed of a suitable refractory material having a specific gravity less than the specific gravity of the molten metal 12, but higher than the specific gravity of the slag 14. In this manner, the slag control shape or body 32 buoyantly floats at the interface 34 formed between the layer of molten metal 12 and the slag layer 14. When the layer of molten metal 12 reaches a predetermined low level, the lower portion of slag control body 32 will first prevent the vortex action from occurring and, as draining is completed, will engage the discharge nozzle 24 in the ladle I 0 and thereby block the further discharge of molten metal and, more importantly, the discharge of slag 14 from the ladle 10.

According to the present invention a slag control shape release apparatus 30 is provided for inserting a slag control shape body 32 into the vessel 10 at the appropriate time determined by an operator or ladlemen monitoring the metal making process. The release apparatus 30 includes a means for releasably mounting the slag control shape or body 32 over the vessel 10 for moving the mounting means between first and second positions and actuating means for moving the mounting means from the first position to the second position, the actuating means operable from a position remote from the vessel 10.

The apparatus 30 also includes means for selectively rotating the apparatus into selective positions away from or over the vessel 10. The rotating means allows the slag control shape body 32 to be mounted to the release apparatus 30 when the release apparatus 30 is rotated away from the vessel 10. The rotating means prevents the release apparatus 30 from rotating during the mounting process. After the body 32 is mounted, the release apparatus 30 can be rotated again to extend the body 32 over the vessel 10.

Figure 2:
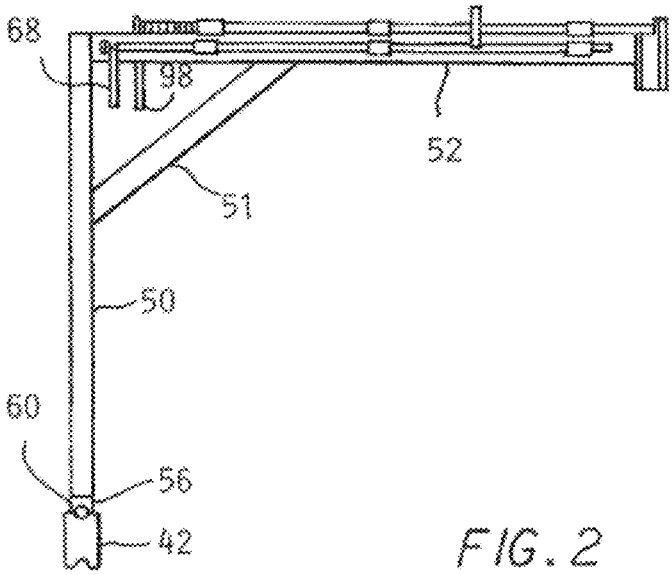
FIG. 2 is a side elevational view of the slag control shape release apparatus illustrating an L-shaped bracket having a vertical section and a horizontal section.
Figure 4:
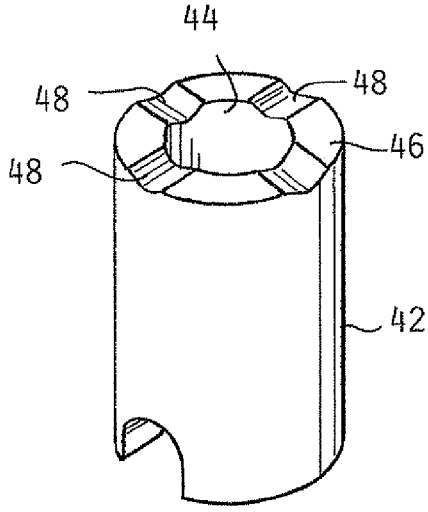
FIG. 4 is a perspective view of a mounting sleeve for the slag control shape release apparatus shown in FIG. 2.

As shown in FIGS. 1 and 2, the release apparatus is in the form of an L-shaped bracket 40. The L-shaped bracket 40 according to the present invention can be mounted on a conventional platform 20 (in phantom) or into the body 11 of the vessel 10. The L-shaped bracket 40 is mounted in the platform 20 or the vessel body 11, and extends upward therefrom so as to place an upper end of the bracket generally in the vicinity over the outlet 24 of the vessel 10. When the L-shaped bracket 40 is mounted on the platform 20, a security gate 41 is placed between the worker and the L-shaped bracket 40. The L-shaped bracket 40 is mounted into the rotating means. The rotating means includes a sleeve 42. The sleeve 42 as shown in FIG. 4 is securely mounted in either a platform 20 or an upper edge of the vessel body 11. The sleeve 42 is a cylindrical body having a through aperture 44 for receiving an end of a rotating shaft 56. The sleeve 42 has an upper edge 46 with a plurality of notches 48 evenly spaced and formed thereon. There is an even number of notches 48 so that one notch is diametrically opposed from another notch. The notches 48 provide means for rotating the L-shaped bracket 40 into selective positions and further for maintaining the L-shaped bracket 40 in the particular position with relationship to the vessel 10.

Figure 3:
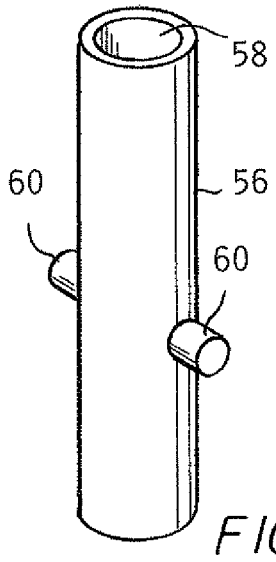
FIG. 3 is a perspective view of a rotating shaft for the slag control shape release apparatus shown in FIG. 2.

The L-shaped bracket 40 includes a vertical portion 50 that is connected into the sleeve 42 and a horizontal portion or arm 52 connected at an upper end to the vertical portion 50. An angle brace 51 can extend between and connect the vertical portion 50 and arm 52. The vertical portion 50 is a cylindrical, tubular bar having a through aperture therein. The arm 52 extends 90° from the vertical portion 50. The vertical portion 50 has one end 54 connected into the rotating shaft 56. As seen in FIG. 3, the rotating shaft 56 is a cylindrical member having a through aperture 58 extending the axial length of the shaft 56. In the illustrative embodiment, the rotating shaft 56 has a length of 7.0 inches. At a generally central location along the axial length of the shaft 56, a pair of diametrically opposing pegs 60 extends from the shaft 56. The pegs 60 are sized and configured for setting in the notches 48 of the sleeve 42. The diameter of the shaft 56 is configured for being received within the through aperture 44 of the sleeve 42 and within the through aperture (not shown) of the vertical portion 50 of the L-shaped bracket 40. The location of the pegs 60 on the rotating shaft 56 is set to eliminate or minimize wobble movement of the L-bracket 40 relative to the sleeve 42.

Figure 5:
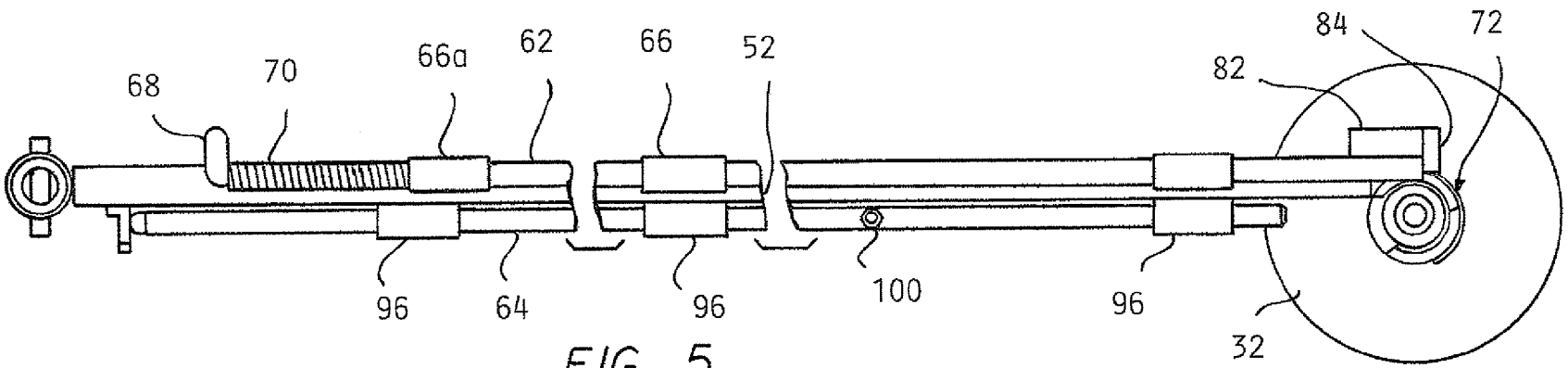
FIGS. 5 and 5*a* are top elevational views of the horizontal section illustrating a bracket sleeve in a closed position and opened position, respectively.
Figure 5A:
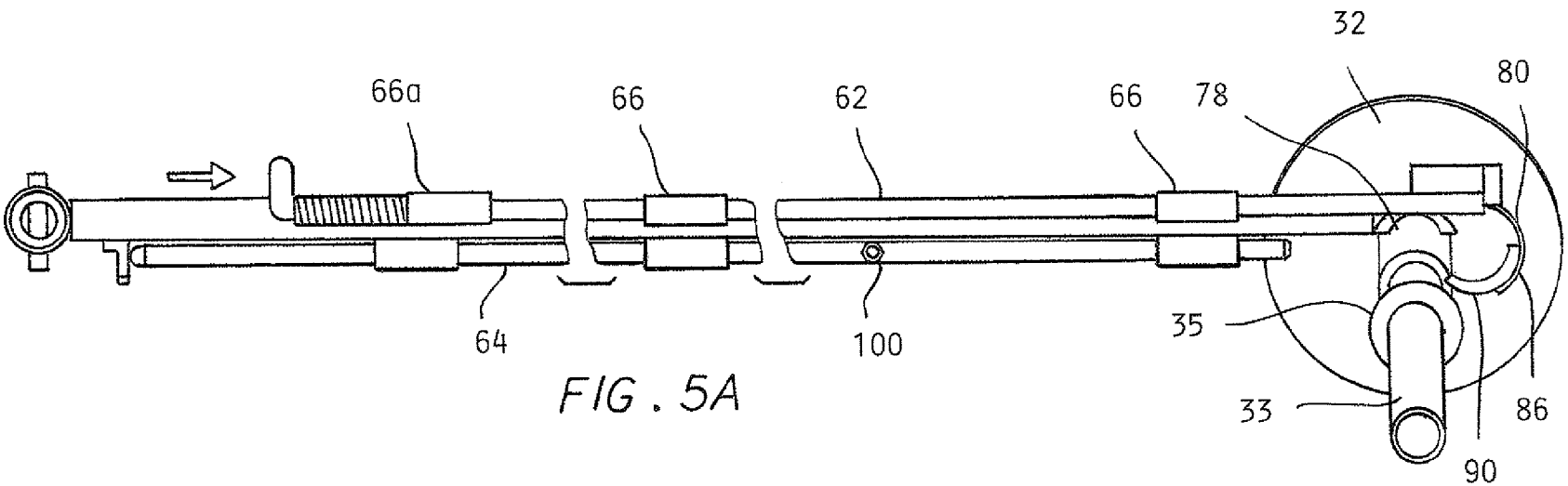

The horizontal arm 52 carries a delivery mechanism assembly as shown in FIGS. 5 and 5A. The delivery mechanism assembly includes a slide pin 62 and a lock pin 64. The slide pin 62 has means for releasably mounting the slag control body 32 at one end and actuates the release of the slag control body 32. In one embodiment, the slide pin 62 also carries the actuating means for releasing the slag control body 32. The slide pin 62 is connected to the arm 52 by means of a plurality of collars 66. The collar 66 is secured to the arm 62 by welding or other conventional means. The collars 66 have a through aperture (not shown). The slide pin 62 is movable through the apertures in the collars 66 along the axial length of the arm 52. A handle 68 angularly extends from one end of the slide pin 62. In the illustrated embodiment, the actuating means is a spring 70. The spring 70 is held in place between the handle 68 and a first collar 66*a*.

Figure 7:
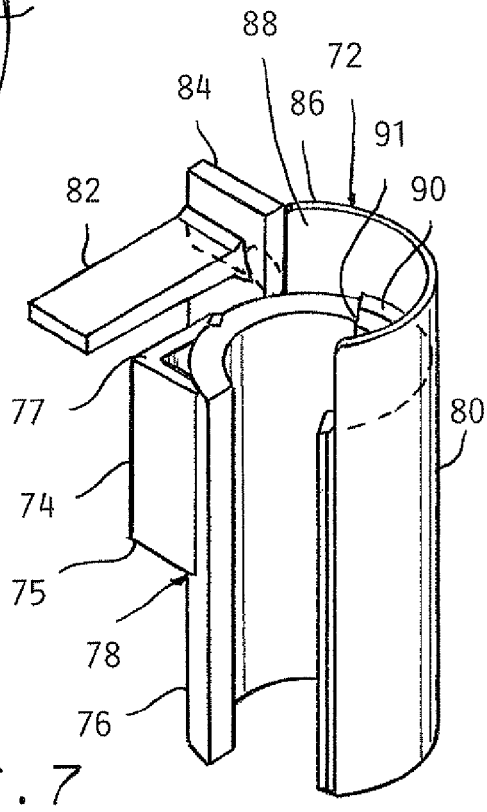
FIG. 7 is a perspective view of the bracket sleeve.

A bracket sleeve 72 is located at the opposing end of the slide pin 62 from the handle 68. The bracket sleeve 72 maintains the stem 33 of the slag control body 32 in an upright, vertical orientation. The spring 70 is biased to maintain the sleeve 72 in a closed position as seen in FIG. 5. The bracket sleeve 72 has a first portion 78 secured to the free end of the arm 52 and a second portion 80 secured to the end of the slide pin 62 so that the second portion 80 moves relative to the stationary first portion 78. The second portion 80 moves relative to the first portion 78 to release the slag body 32. The first portion 78 of the bracket sleeve 72 includes a corner piece 74 formed by two planar edges 75, 77 connected together and an arcuate tubular portion 76. The planar edge 77 is secured to the arm 52. Portions of the corner piece 74 are also connected to the arcuate tubular portion 76. An outer surface of the arcuate tubular portion 76 is fixedly secured to two planar edges 75,77 of the corner piece 74. The corner piece is best shown in FIG. 7.

The second portion 80 of the bracket sleeve 72 includes a short metallic bar 82 secured to the free end of the slide pin 62. The short bar 82 is teed in connection to a second short bar 84 which is also connected by welding or other conventional means to one edge of another arcuate portion 86 formed from a thin walled pipe. The thin walled pipe 86 is sized such that the inner surface 88 accommodates the outer surface of another portion of the arcuate tubing 90. The second arcuate tubing 90 is positioned within the thin walled pipe 86 so that when the bracket sleeve 72 is in a closed position, as shown in FIG. 7 an outer longitudinal edge of tubing 90 abuts the adjacent longitudinal outer edge of tubular portion 76 forming a seam 91. When the bracket sleeves 72 is in a closed position, the arcuate tubular portion 76 and 90 join to form a continuous arcuate portion greater than 180°, and preferably greater than 270°.

Figure 6:
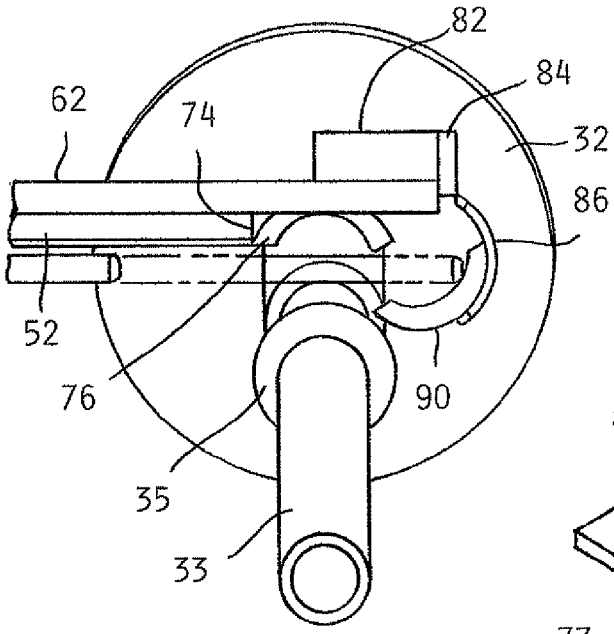
FIG. 6 is a top elevational view of the horizontal section illustrating the bracket sleeve in an open/release position.

As can be seen in FIG. 5, when the bracket sleeve 72 is in the closed position, the slag control shape or body 32 is held above the vessel 10. The arcuate tubular portions 76 and 90 cooperate to encircle the flange 35 of the stem 33 of the slag control shape or body 32 and prevent the slag control body 32 from falling into the vessel 10. When the handle 68 is pushed in the direction of the arrow A, as shown in FIG. 6, the handle 68 compresses spring 70 and moves the slide pin 62 so that the second portion 80 of the bracket sleeve 72 moves away from the first portion 78 of the bracket sleeve 72. The two arcuate tubular portions 76 and 90 are then separated in order to release the slag body 32, as seen in FIG. 5A. Upon release of the handle 68, the spring 70 is biased to move the handle 68 and slide pin 62 to the left as viewed in FIG. 5 which thereby again closes the bracket sleeve 72.

The arm 52 of the delivery mechanism assembly further carries a lock pin 64 along its axial length. The lock pin 64 maintains the bracket sleeve 72 in an open position for placement of the slag control shape or body 32. The lock pin 64 is slidable held along the arm 52 by a plurality of collars 96. The collars 96 are similar to the collars 66 on the slide pin 62 and are secured to the lock pin 64 in the same manner. Looking at FIGS. 1 and 2 the lock pin 64 has a handle 98 at an end adjacent to the vertical portion 50 of the L-shaped bracket 40. The handle 98 extends angularly from the lock pin 64. The handle 98 assists the fore and aft movement of the lock pin 64 relative to the vertical portion 50. The position of the first collar 96*a* provides a stop to the handle from extending beyond the arm 52. The lock pin 64 can also have a peg 100 angularly extending from the lock pin 64. The peg 100 is situated between two adjacent collars 96 which act as stops to limit the movement of the lock pin 64 in either lateral direction. The lock pin 64 shown in FIGS. 5 and 6 is in an unlocked position. When the lock pin 64 is extended to the left as shown in phantom in FIG. 6, the lock pin 64 holds the bracket sleeve 72 into the open and released position even when the handle 68 of the slide pin 62 has been released. By moving the lock pin 64 to the left toward the vertical portion 50 of the L-bracket 40, the slide pin 62 also moves to the left toward the vertical portion 50 of the L-bracket 40 by the force of spring 70 so that the second portion 80 again cooperates with the first portion 78 to maintain the bracket sleeve 72 in a closed position.

In summary the L-shaped loading bracket as disclosed for sue with molten metal vessels 20 which enables a slag control shape body 32 be easily inserted into the molten metal vessel at the appropriate time without an operator manually inserting the slag control body into the vessel 10. The apparatus is conveniently mounted on a platform adjacent to the edge of the vessel 10; or directly on the edge of the vessel 10. The L-shaped bracket can be initially rotated away from the vessel for connection of the slag control shape body thereto. The diametrically opposing notches 48 hold the pegs 60 of the rotating shaft 56 in place to prevent movement of the L-shaped bracket 40 during connection of the slag control shape body 32. After the slag control shape body is installed on the L-shaped loading bracket 40,the bracket 40 can be rotated so that the slag body 32 extends over the vessel 10. The delivery mechanism provides a quick manual release of the slag body when the operator determines the appropriate moment.

What is claimed is:

1. A slag control shape release apparatus for a molten receptacle, the apparatus comprising:

a sleeve connected to the metal receptacle or an adjacent base;

an L-shaped bracket mountable to the sleeve the L-shaped bracket carrying means for releasably mounting a slag control shape, the mounting means movable between a first position mounting a slag control shape on the L-shaped bracket and a second position releasing the slag control shape for falling into the molten metal receptacle, the means for releasably mounting the slag control shape includes a spring biased slide pin;

the L-shaped bracket rotatable relative to the sleeve between a first position away from the receptacle for loading a slag control shape on the L-shaped bracket slag control shape mounting means and a second position wherein the slag control shape mounting means disposes the slag control shape over the receptable.

2. The apparatus of claim 1 further comprising a rotatable shaft disposed between the sleeve and L-shaped bracket.

3. The apparatus of claim 2, wherein the L-shaped bracket have a vertical bar mounted in the rotatable shaft and a horizontal portion attached at an end of the vertical bar distal from the sleeve, said horizontal portion carrying the means for releasably mounting the slag control shape.

4. The apparatus of claim 3, wherein said horizontal portion includes a bar carrying a slide pin and a lock pin, said bar having a first end secured to the vertical portion.

5. The apparatus of claim 3, wherein the means for releasably mounting the slag control shape includes a bracket sleeve having one portion disposed on the bar and the other portion disposed on the slide pin.

6. The apparatus of claim 4, wherein the slide pin slides through a plurality of collars connected to the bar, said slide pin having one end with a handle and a biasing spring disposed between the handle and a first collar, said biasing spring coupled to the first collar.

7. The apparatus of claim 5, wherein the biasing spring is biased to a first position wherein the bracket sleeve is in a closed position.

8. The apparatus of claim 5, wherein the slide pin has an opposing end connected to the bracket sleeve.

9. The apparatus of claim 7, wherein the bar has an opposing free end distally spaced from the first end and a first portion of the bracket sleeve secured at the free end, said first portion of the bracket sleeve including an arcuate member having an inner surface open for receiving a portion of the slag control shape.

10. A slag control shape release apparatus for a molten metal receptacle, the apparatus comprising:

a sleeve connected to the metal receptacle or an adjacent base;

an L-shaped bracket mountable to the sleeve, the L-shaped bracket rotatable relative to the sleeve;

the bracket having means for releasably mounting a slag control shape, the mounting means movable between a first position releasably mounting a slag control shape and a second position releasing the slag control shape for falling into the molten metal receptacle, the means for releasably mounting the slag control shape includes a spring biased slide pin;

a rotatable shaft disposed between the sleeve and L-shaped bracket;

the L-shaped bracket having a vertical bar mounted in the rotatable shaft and a horizontal portion attached at an end of the vertical bar distal from the sleeve, the horizontal portion carrying the means for releasably mounting the slag control shape; and wherein the rotatable shaft is a cylindrical member having a through center aperture extending the length of the shaft, and having diametrically opposing pegs extending from the shaft in a central portion of the shaft, and wherein the sleeve is a cylindrical member having a through center aperture with a diameter to snugly receive one end of the shaft.

11. The apparatus of claim 10, wherein the sleeve has a top surface with a plurality of notches evenly spaced into the top surface, said notches configured for receiving the diametrically opposing pegs on the shaft.

12. A slag control shape release apparatus for a molten metal receptacle, the apparatus comprising:

a sleeve connected to the metal receptacle or an adjacent base;

an L-shaped bracket mountable to the sleeve, the L-shaped bracket rotatable relative to the sleeve;

the bracket having means for releasably mounting a slag control shape, the mounting means movable between a first position releasably mounting a slag control shape and a second position releasing the slag control shape for falling into the molten metal receptacle, the means for releasably mounting the slag control shape includes a spring biased slide pin;

a rotatable shaft disposed between the sleeve and L-shaped bracket;

the L-shaped bracket having a vertical bar mounted in the rotatable shaft and a horizontal portion attached at an end of the vertical bar distal from the sleeve, the horizontal portion carrying the means for releasably mounting the slag control shape;

the means for releasibly mounting the slag control shape including a bracket sleeve having one portion disposed on the bar and the other portion disposed on the slide pin;

the biasing spring biased to a first position wherein the bracket sleeve is in a closed position;

the bar has an opposing free end distally spaced from the first end and a first portion of the bracket sleeve secured at the free end, said first portion of the bracket sleeve including an arcuate member having an inner surface open for receiving a portion of the slag control shape; and wherein the slide pin is carrying a second portion of the bracket sleeve, the portion including a second arcuate member having an inner surface open for receiving a portion of the slag control shape and wherein the second portion of the bracket sleeve is movable relative to the first portion of the bracket sleeve.

13. The apparatus of claim 12, wherein the first and second portions of the bracket sleeve cooperate to form an arcuate formation of at least 270° around the portion of the slag control shape to hold the slag control shape when the bracket sleeve is in the closed position.

14. The apparatus of claim 13, wherein the lock pin selectively holds the bracket sleeve in an open position, wherein the second portion of the bracket sleeve is spaced from the first portion of the bracket above.

* * * * *